US005152533A

United States Patent [19]

Radakovich

[11] Patent Number: 5,152,533

[45] Date of Patent: Oct. 6, 1992

[54] GOLF CLUB SIGHTING APPARATUS AND METHOD

[76] Inventor: Daniel L. Radakovich, 14479 Regency Dr., Strongsville, Ohio 44135

[21] Appl. No.: 703,272

[22] Filed: May 20, 1991

[51] Int. Cl.[5] ..... A63B 69/36

[52] U.S. Cl. ..... 273/186.2; 273/81 B; 273/162 D; 273/194 R; 273/163 A; 273/164.1

[58] Field of Search ..... 273/186 A, 183 D, 183 E, 273/81 B, 163 R, 163 A, 164, 162 R, 162 A, 194 R, 81 R, 81 B

[56] References Cited

U.S. PATENT DOCUMENTS

| | | | |
|---|---|---|---|
| 1,126,208 | 1/1915 | Hayford | 273/163 A |
| 1,488,900 | 4/1924 | Armstrong | 273/163 A |
| 1,604,696 | 10/1926 | Jordy | 273/81 B |
| 3,459,426 | 8/1969 | Sherwood | 273/164 X |
| 4,204,332 | 5/1980 | Gray | 273/183 D X |
| 4,482,155 | 11/1984 | Higley | 273/164 |
| 4,569,525 | 2/1986 | Folger | 273/81 B |
| 4,781,382 | 11/1988 | Hargraves | 273/183 B |
| 4,962,931 | 10/1990 | Jazdzyk | 273/183 D |
| 5,026,062 | 6/1991 | Freeberg | 273/81 B X |
| 5,058,891 | 10/1991 | Takeuchi | 273/81.3 |

*Primary Examiner*—George J. Marlo

*Attorney, Agent, or Firm*—H. Keith Hauger

[57] ABSTRACT

A golf club sighting apparatus and method wherein designs and/or arrows demarcating the target direction are set forth on the apparatus for clear visibility to the golfer's eye. Most variations allow for parallel alignment to a ground surface to achieve proper lie. The preferred embodiment is a wing-shaped member wrapping around but not touching the left wrist, providing a design or arrow directly along a target directional line. Ultimately, this preferred embodiment is removed, other embodiments are inserted including a rectangular and triangular frame member attachable to the shaft to train the golfer to finally use only a simple disk or sticker member attachable to the end of the golf club butt handle and being legitimate for tournament play. Any of the disk members may be used in combination with the rectangular or triangular members for further development of the abilities needed for proper swing. In all cases, the shaft itself is shaded on a demarcated ¼ sector running vertically on the shaft for visual extension to the golf club head face. Optionally, the club face and upper surface may be shaded to a center line for sighting a designated target. Most embodiments include a downswing arrow 45 degrees to the target arrow for proper positioning of the golf club during the downswing toward the golf ball.

17 Claims, 5 Drawing Sheets

GOLF CLUB SIGHTING APPARATUS AND METHOD

BACKGROUND OF THE INVENTION

1. FIELD OF THE INVENTION

This invention relates generally to a golf club sighting apparatus for attachment to a golf club for precise alignment of the golf club head to a golf ball for improving accuracy to a designated target.

2. DESCRIPTION OF THE PRIOR ART

The game of golf is enjoyed presently around the world more than ever in prior history. Golf is considered to be a recreational sport by many, but to the true enthusiast or professional, there is a never ending search for improvement and ultimately perfection in what is a fading art turned science. Previous devices like Hargraves U.S. Pat. No. 4,781,382 disclose an attachment which actually touches the golfer's hand to assist him or her in maintaining proper position of the arms. Hayford U.S. Pat. No. 1,126,208 and Armstrong U.S. Pat. No. 1,488,900 show golf clubs with visual markings on one face. U.S. Pat. No. 4,482,155 to Higley indicates a golf club alignment indicator utilizing a ball and bubble mechanism attached to a handle butt. U.S. Pat. No. 3,459,426 to Sherwood is of general interest for its disclosure of a golf club putter handle having flat extended faces. The present invention enables everyone from the beginner, to amateur, and ultimately the professional to improve their skills, whether for recreation or professional tournament play.

SUMMARY OF THE INVENTION

It is, therefore, an object of the present invention to contribute to a golfer's improvement of alignment, and most important, control of the club face.

It is the further object of this invention to develop control of a golfer's left arm to which the swing and follow through are directly dependent.

It is the further object of this invention to improve a golfer's waggle, i.e. the back and forth motion along an intended line of flight prior to the backswing and forward swing resultant in ultimate impact to the golf ball.

It is the further object of this invention to assure that the club face is aimed square or 90 degrees to the target line by aligning the bottom edge of the club face parallel to the ground allowing the force of the swing to be direct on the center line of the club face and diametric to the ball at impact.

It is the further object of this invention to position the hands either in front of, even with, or behind the ball on a golf club grip at impact to control the angle of loft.

It is the further object of this invention to assure that the back of the left hand moves along the intended line of flight at impact and up to approximately 12 inches beyond in the follow through.

It is the further object of this invention to accomplish the aforesaid proper alignment of the golf club by locating target arrows and downswing arrows on the golf sighting apparatus being closer to the eyes than the actual club face and ball.

It is the further object of this invention to provide an extra checkpoint for accomplishing the aforesaid proper alignment of the golf club.

It is the further object of this invention to provide the golfer with a series of steps utilizing various embodiments or combinations thereof enabling a golfer to progress through a method of teaching proper swing and position.

It is the further object of this invention to ultimately make use of only a miniature disk version embodiment for attachment to the club head butt being legal for even professional tournament play.

It is the further object of this invention to eliminate wasted motion in the hands during the backswing by viewing the vertical downward direction of the aforesaid downswing arrow.

More specifically, the present invention is a golf club sighting apparatus for attachment to a golf club for precise alignment of a golf club head to a golf ball for directing said golf ball to a designated target comprising a sighting means for attachment to a golf club shaft; a plurality of shaded designs on an upper surface of said sighting means visible to a golfer for said precise alignment along a sight line to said designated target; an attachment means for securing said sighting means to said golf club; and a demarcated ¼ sector running vertically along said golf club shaft and a golf club grip for visual extension to a golf club head face for said precise alignment.

These objects, as well as other objects and advantages of the present invention, will become apparent from the following description, on reference to the illustrations appended hereto.

BRIEF DESCRIPTION OF THE DRAWINGS

FIG. 1—1 is a blown-up view of a golfer's hand positioned on a golf club grip having attached thereto an adjustable wing member sighting means.

FIG. 2-1 is a side view sketch of a golf club indicating its X-Y plane surface being the ground surface and a Z axis being the vertical axis with an angle from the X-Y plane to the golf club shaft.

DESCRIPTION OF PREFERRED EMBODIMENTS

Figure 1:
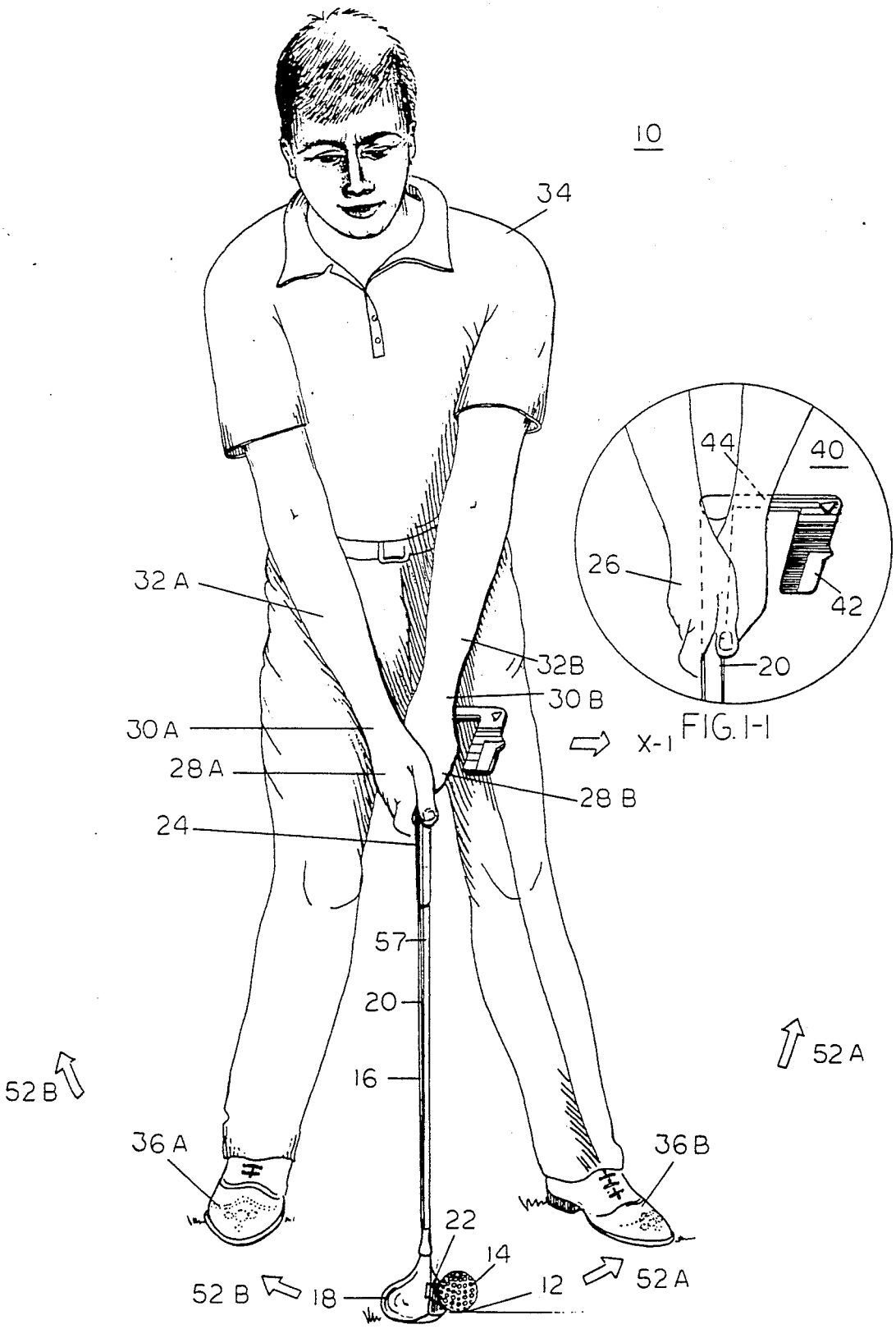
FIG. 1 illustrates a golfer addressing a golf ball with the subject golf club sighting apparatus.

Referring to the drawings, FIG. 1 shows a golfer 10 addressing a golf ball 14 on horizontal plane X-Y being a playing surface 12 with a golf club 16. A preferred embodiment of a golf club sighting apparatus being an adjustable wing member 40 is shown attached to a golf club shaft 20 at a golf club butt handle 24 for alignment of a golf club head 18 having a golf club head face 22. Golfer 10 stands so that the golf club head face 22 having a golf club head bottom surface 23 is parallel to playing surface 12 being referred to as level lie 54. Said adjustable wing member 40 has wing section 42 and arm support section 44 whereby the wing section 42 is adjusted to be exactly perpendicular to target directional line X-1 which is parallel to target directional line X-2 of golf ball 14. Golfer 10 levels wing section 42 to achieve level lie 54 of golf club face 22. Adjustable wing member 40 is now exactly synchronized with golf club head face 22. If wing section 42 is turned left at impact, golf club head face 22 will be facing left at impact. If wing section 42 is not level to playing surface 12 at impact, golf club head face 22 will not be level at impact.

Target arrow 46 is located on upper wing surface 60*a* for directing golf ball 14 along target directional line X-2. If target arrow 46 is pointed down toward playing surface 12 at impact, the loft of golf club 16 will decrease at impact.

Golfer 10 has hands 26 which only contact golf club 16 near golf club butt handle 24. Adjustable wing member 40 helps golfer 10 position left hand 28*b* so that the back of left hand 28*b* faces down golf club 16 and perpendicular to target arrow 46. When left hand 28*b* is so positioned, right hand 28*a* follows in place on golf club 16. Adjustable wing member 40 also helps golfer 10 to position right wrist 30*a* and left wrist 30*b* so they are held high when addressing golf ball 14 with forward swing 52*a*.

Figures 1, 2:
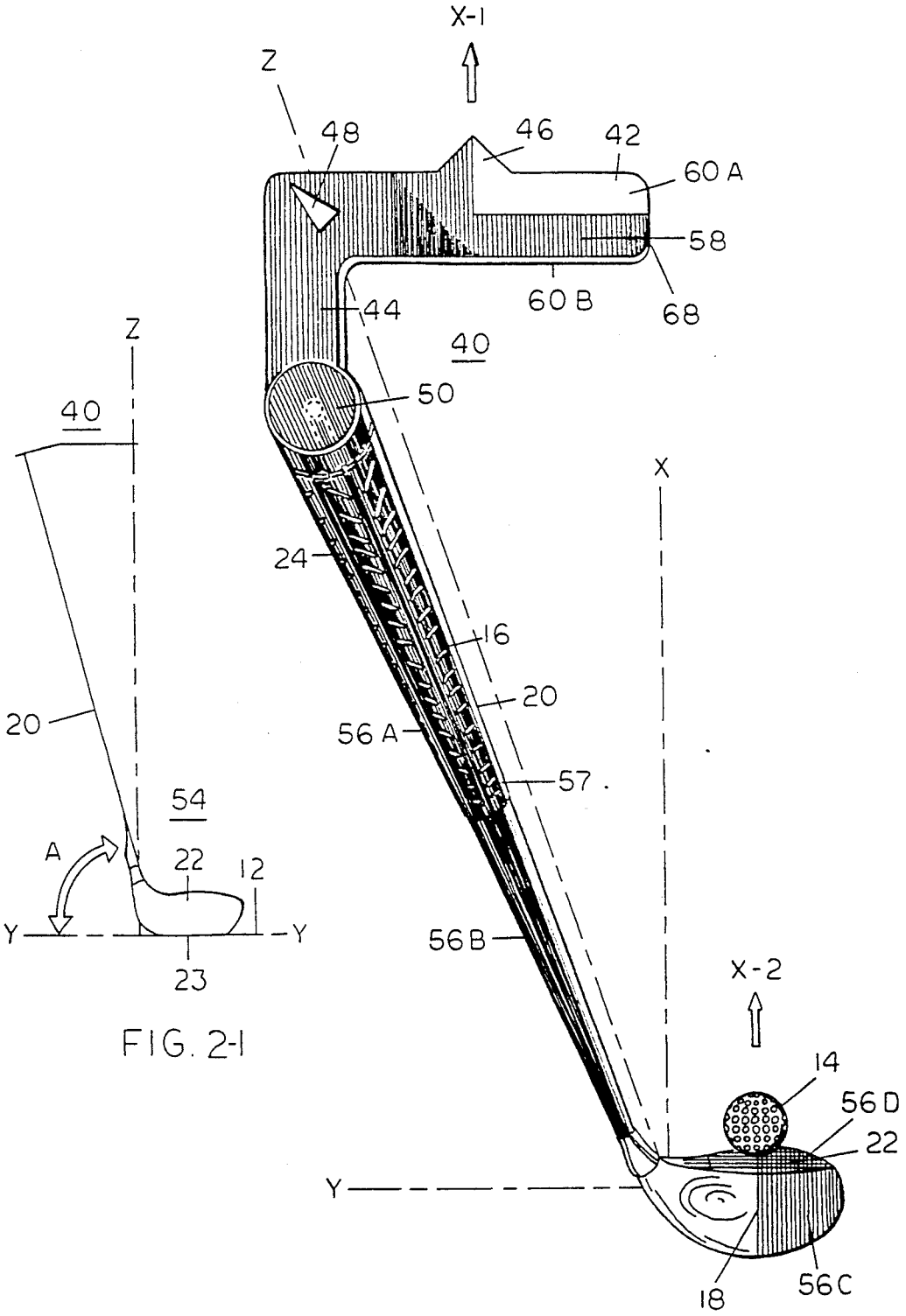
FIG. 2 represents a top perspective view of a golf club with an adjustable wing member sighting means.

Adjustable wing member 40 is very useful in learning how to waggle, i.e. move back and forth along target direction line X-1 shown in FIG. 1 or target direction line X-2 as shown in FIG. 2. It is known that the waggle provides physical and mental preparation to forward swing 52*a*.

Adjustable wing member 40 has a primary downswing arrow 48 located on downswing corner surface 66, and offset 45 degrees to target line 46 for indicating the direction of movement of the golf club butt handle 24 before the unhinging, supination and rotation of right wrist 30*a* and left wrist 30*b*. Primary downswing arrow 48 reaches its lowest point along or about imaginary vertical axis Z at a point where right wrist 30*a* and left wrist 30*b* unhinge. Golf club head face 22 must be kept perpendicular to target directional line X-2 facing away from golfer 10 as long as possible at impact especially, but when right wrist 30*a*, and left wrist 30*b* unhinge, golf club head face 22 must become perpendicular to or squares with target direction line X-2. Primary downswing arrow 48 is instrumental in achieving and understanding the application of this principle.

Figure 12:
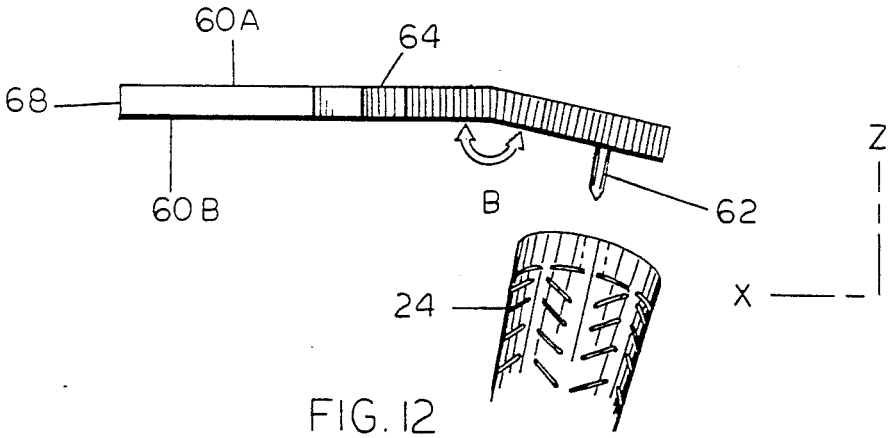
FIG. 12 represents a front elevational view of an adjustable wing member sighting means.
Figure 13:
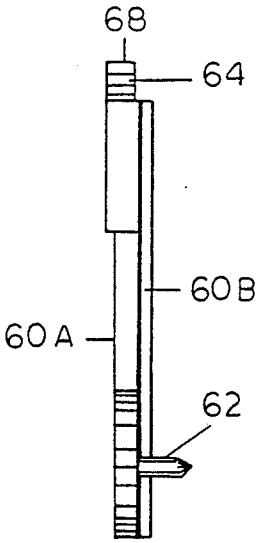
FIG. 13 represents a side elevational view of an adjustable wing member sighting means.

Structurally, adjustable wing member 40 further consists of arm support section 44 for insertion into attachment means cavity 63 at shaft butt end 50 by a pin means 62 perpendicular to lower wing surface 60*b*. Lower wing surface 60*b* is separated from upper wing surface 60*a* by wing thickness 68 for rigidity. Adjustable wing member 40 is constructed from preferably a flexible plastic material for adjusting wing angle B shown in FIG. 12 to make wing section 42 parallel to playing surface 12. This same goal may be accomplished by other means like a hinge (not shown). Wing shading 58 forms an aiming line 46 in protruding triangular tip section 64 along target directional line X-1, and squaring line 59 for squaring golf club head face 22 to golf ball 14.

FIGS. 3, 4, 5, and 6 illustrate derivatives of the preferred embodiment adjustable wing member 40. A frame member 100 is shown having a fastening means 102 for attachment to golf club shaft 20 at a position located below butt handle 24. Target arrow 46 is located on rectangle upper surface 114 for directing golf ball 14 along target directional line X-2 as aforesaid. Rectangular frame member 100 is structurally a rectangle frame 104 consisting of rectangle outer leg 108 and rectangle inner leg 110 parallel to each other and rectangle lower surface 112 parallel to rectangle upper surface 114 and has the purpose of giving golfer 10 a visual impression of a swinging door closing shut at the point of impact of golf club head face 22 to golf ball 14. Rectangle lower surface 112 and rectangle upper surface 114 should be parallel to ground surface 12 at impact. Rectangle shading 106 is visible to the eye of golfer 10 on rectangle upper surface 114 whereon at a center line thereof target arrow 46 is located.

Triangular frame member 120 attaches to golf club shaft 20 by attachment means 122 at a point below golf club butt handle 24. Target arrow 46 on triangle upper surface 130 for directing golf ball 14 along directional line X-2 as aforesaid. Structurally, triangular frame member is triangle frame 124 having triangle outer surface 128 being a hypotenuse of a 90 degree triangle, triangle upper surface 130 being parallel to ground surface 12 at impact. Triangular frame member 120 and rectangular frame member 100 are designed to function in the same manner as the preferred embodiment adjustable wing member 40. Triangle outer surface 128 will be perpendicular to ground surface 12 and triangle upper surface will be parallel to ground surface 12 at the time golf club head face 22 impacts golf ball 14. Secondary downswing arrow 49 seen in FIG. 3 may be added as a feature to golf club 16 located on golf club butt handle 24 during backward swing motion 52*b* for further direction of golf club butt handle 24 before the unhinging, supination and rotation of right wrist 30*a* and left wrist 30*b* as aforesaid.

Figure 6:
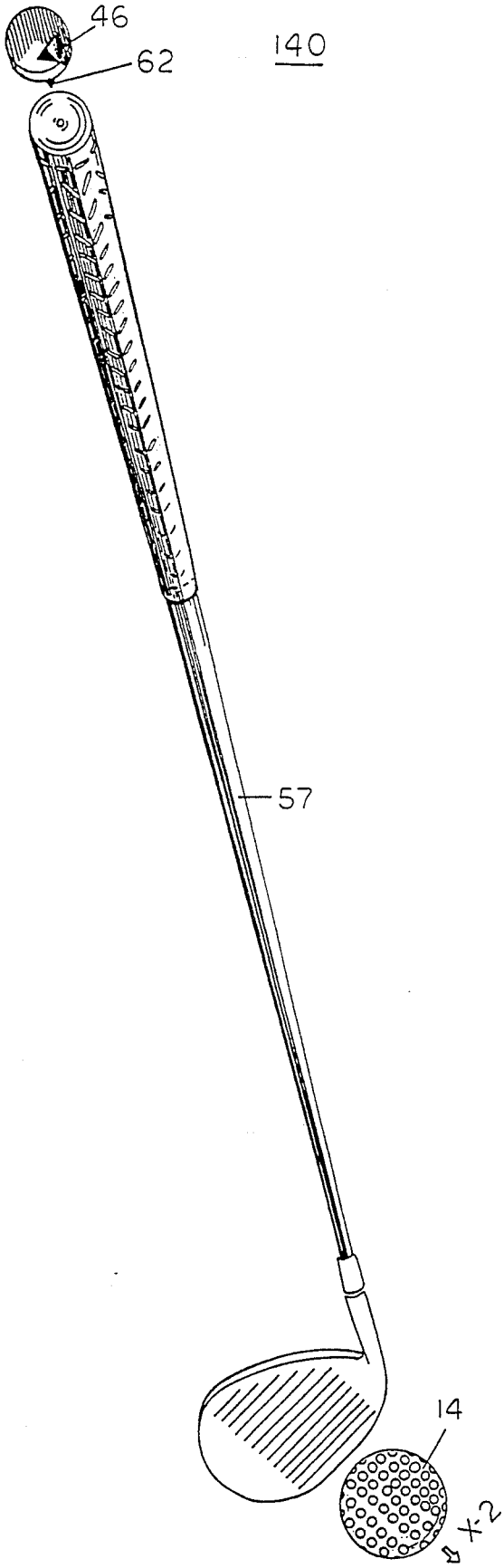
FIG. 6 illustrates a golf club with a non-tilted disk member sighting means and demarcated ¼ sector running vertically along a golf club shaft.

Another embodiment of a golf club sighting apparatus shown in FIG. 6 is disk member 140 for insertion into shaft butt end 50 by a pin means 62. Target arrow 46 is located on disk member 140 as shown and serves the same purpose as described for the derivative embodiments. Disk member 140 is visually the closest point to the eye of golfer 10 and is suitable in combination with triangular frame member 120 and rectangular frame member 100 or without any other derivative embodiment. Disk member 140 rotates about vertical axis Z running along golf club shaft 20 for positioning target arrow 46 along target directional line X-2. It is ultimately the goal to teach golfer 10 proper control and swing of golf club 16 through experimentation with the preferred and derivative embodiments until such time as all embodiments may be removed with the exception of disk member 140 which is legitimate for professional tournament play.

Figure 9:
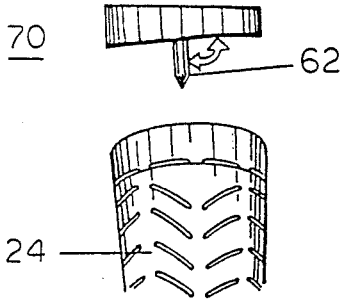
FIG. 9 represents a side view sketch of a beveled mini-sighting member for insertion into a golf club shaft.
Figure 10:
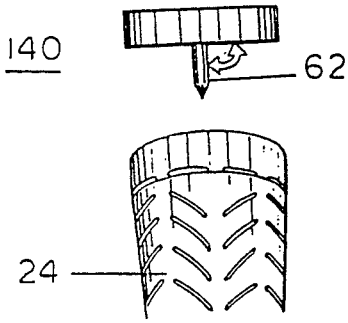
FIG. 10 represents a side view sketch of a non-tilted disk member for insertion into a golf club shaft.
Figure 11:
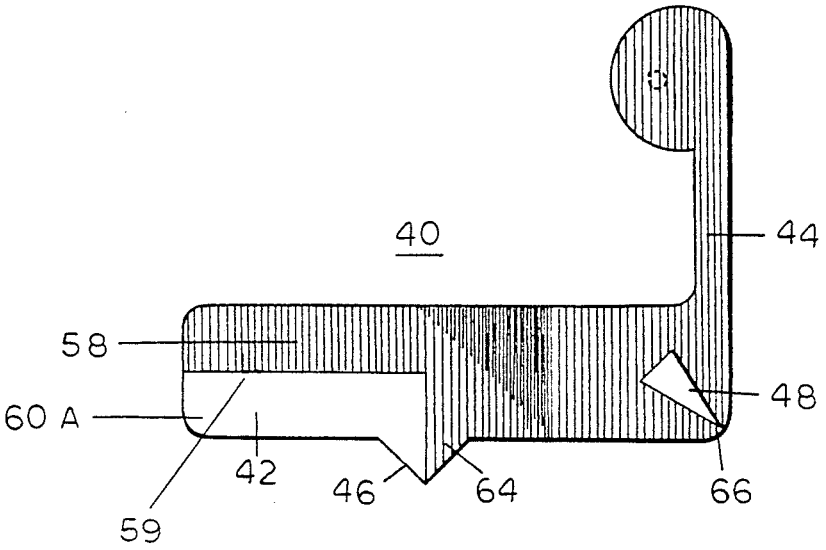
FIG. 11 represents a top view of an adjustable wing member sighting means for insertion into a golf club shaft.

One derivative of disk member 140 is beveled disk member 70 shown in FIG. 9 in combination with rectangular frame member 100. Beveled disk member 70 is substantially the same as disk member 140 with the exception of being a beveled disk as shown to make a top surface of said beveled disk member 70 parallel to ground surface 12 at the time of impact with golf ball 14. It is noted in FIG. 2-1 that golf club shaft 20 has an angle to ground surface 12 being club angle A. Beveled disk member 70 compensates for leveling a top surface of beveled disk member 70 at a time when golf club 16 is at level lie 54. FIG. 1 further illustrates the position of golfer 10 for level lie 54 wherein shoulders 34 are parallel to playing surface 12, right foot **36*a* and left foot 36*b* are firmly placed on playing surface 12, and right arm 32*a* and left arm 32*b* are firmly positioned on golf club butt handle 24 in accordance with the alignment as aforesaid of left wrist 30*b*** with a golf club sighting apparatus.

Figure 5:
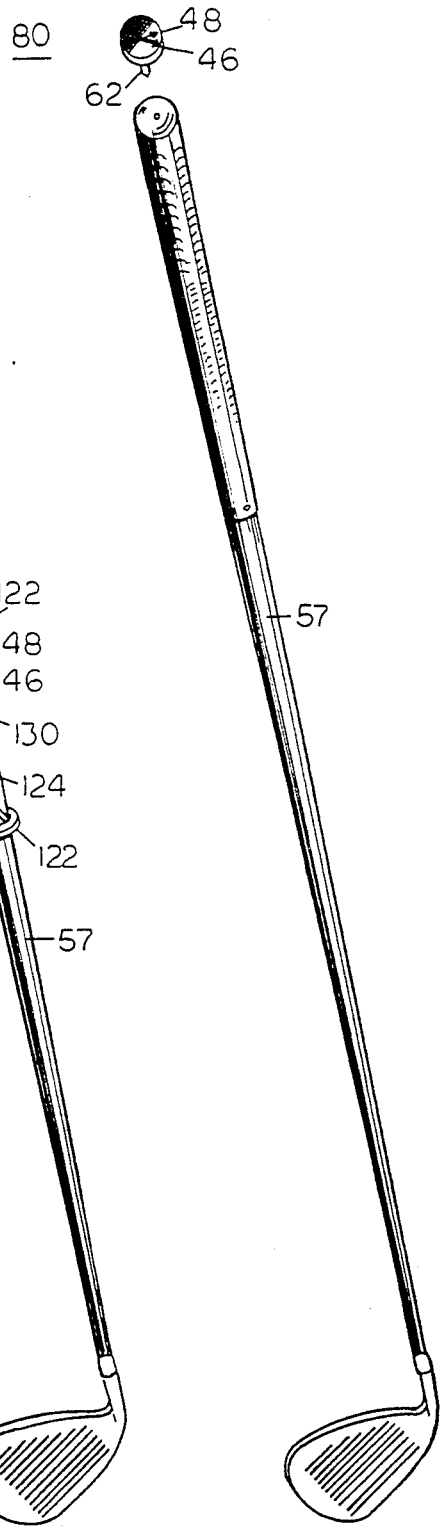
FIG. 5 illustrates a golf club with a tilted disk member sighting means and demarcated ¼ sector running vertically along a golf club shaft.
Figure 7:
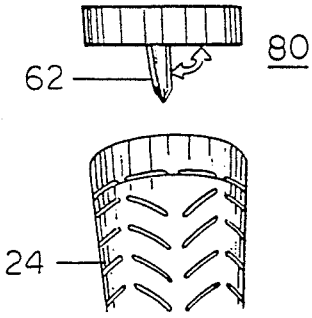
FIG. 7 represents a side view sketch of a tilted disk member for insertion into a golf club shaft.

Another variation of disk member 140 is tilted disk member 80 which includes a tilted pin 62 so that disc member 140 is tilted at an angle to shaft butt end 50 as further illustrated in FIGS. 5 and 7 serving the purposes aforesaid to establish level lie 54.

It is disclosed that target arrow 46 and primary downswing arrow 48 may be set forth on any surface of those embodiments described herein and the design may be varied in the form of distinct arrows as shown in FIG. 5. It is not shown in the drawings, but it is disclosed herein that disk member 140 may also be a sticker for placement on shaft butt end 50.

Figure 4:
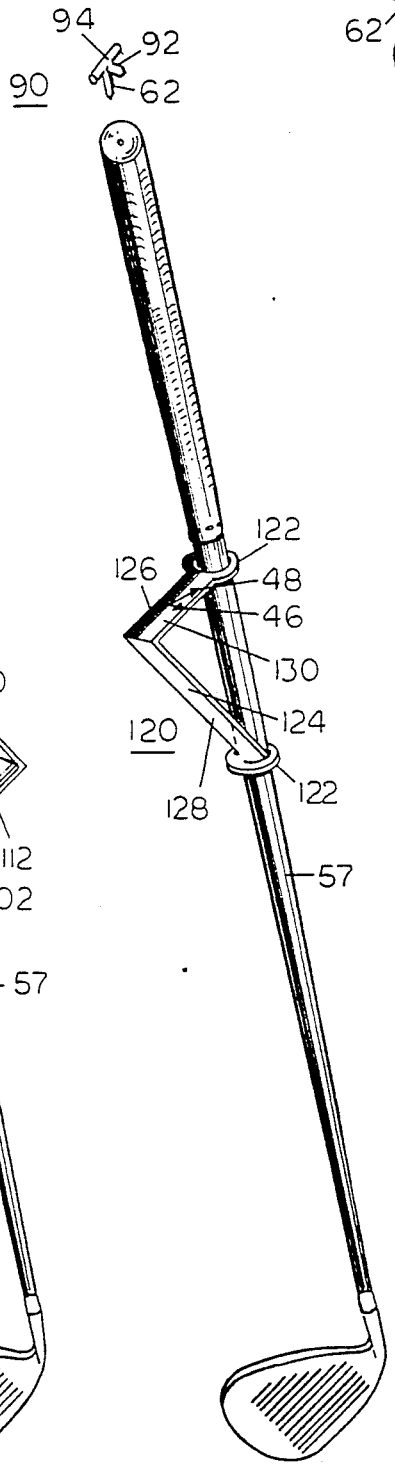
FIG. 4 illustrates a golf club with a right triangular frame member sighting means, a demarcated ¼ sector running vertically along a golf club shaft in combination with a tilted mini sighting means.
Figure 8:
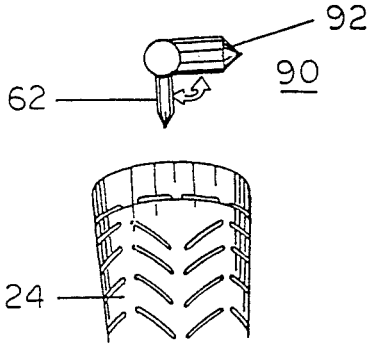
FIG. 8 represents a side view sketch of a tilted mini-sighting member for insertion into a golf club shaft.

Another embodiment of a golf club sighting apparatus is a tilted mini sighting member 90 as shown in FIGS. 4 and 8 comprising a target arrow member 92 serving the same purpose as target arrow 46 and cross bar member 94 serving the same purpose as squaring line 59.

Figure 3:
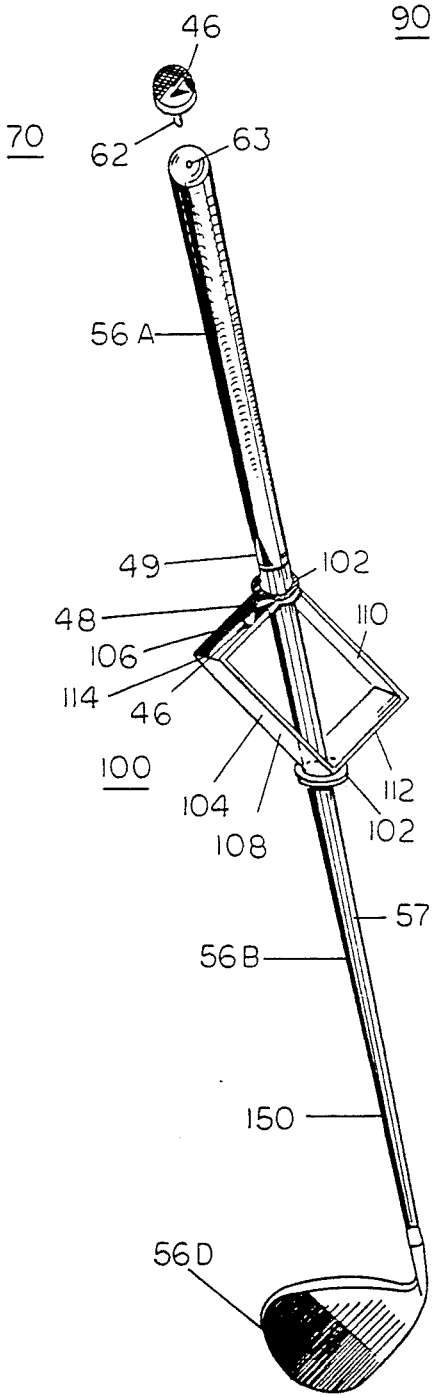
FIG. 3 illustrates a golf club with a rectangular frame member sighting means, a demarcated ¼ sector running vertically along a golf club shaft in combination with a beveled disk member sighting means.

Colored shading is utilized along golf club shaft 20 including golf club butt handle 24 in combination with any or none of the aforesaid embodiments. Grip color shading **56*a* and shaft color shading 56*b* are generally of a darker color, preferably black, and allow for a lighter shading being demarcated ¼ sector 57 running vertically along golf club circular shaft 20, being a front right quarter looking along an X axis on target directional line X-1 and target directional line X-2. Demarcated ¼ sector 57 running the full length of golf club circular shaft 20 provides visual extension of a golf club sighting apparatus as aforesaid through golf club butt handle 24 and golf club shaft 20 to golf club head face 22. Demarcated ¼ sector 57 is synchronized with a golf club sighting apparatus and golf club head face 22 to depict the clearest straight line visually possible to golfer 10 up and down golf club shaft 20. Demarcated ¼ sector 57 transforms golf club 16 from a 360 degree tool to a 90 degree tool; and visually "squares-up" golf club butt handle 24 and golf club shaft 20 for purposes of aligning golf club head face 22 to golf ball 14. Careless alignment errors are eliminated by use of demarcated ¼ sector 57. Further shading of golf club head 18 is seen as head color shading 56*c* to a center line of golf club head 18 for proper alignment of golf ball 14 along target directional line X-2. FIG. 3 illustrates further shading on a golf club iron 150 being face color shading 56*d* to a center line of golf club head face 22 of golf club iron 150**.

I claim:

1. A golf club including a circular shaft, a head, a grip, and sighting apparatus for attachment thereto for precise alignment of the golf club head with a golf ball for directing said golf ball to a designated target, comprising:

an attachment means for detachably securing said sighting apparatus to an upper portion of said shaft, said sighting apparatus including an upper surface;

shading on said upper surface visible to a golfer while addressing a golf ball for providing a sight line to said designated target;

a demarcated ¼ sector running vertically along said golf club shaft and said golf club grip, and being visible to said golfer while addressing a golf ball with said club for visual extension to a golf club head face for said precise alignment.

2. A golf club including sighting apparatus to claim 1, wherein said sighting apparatus comprises an adjustable wing member positioned parallel to a lower surface of said golf club head, said adjustable wing member being fixed to a support member enabling a left hand to be positioned on said golf club grip without touching said golf club sighting apparatus, synchronizing a back of said left hand to be perpendicular to said sight line.

3. A golf club including sighting apparatus according to claim 2, wherein said attachment means is a pin located in an end of said support member 90 degrees to a lower surface of said support member for press-fitting into a cavity on an end surface of said golf club grip.

4. A golf club including sighting apparatus according to claim 2, wherein said shading includes a first shaded design which forms a target arrow on a center line of an upper surface of said adjustable wing member pointing on said sight line for said precise alignment of said golf club head face to address said golf ball on said sight line to said designated target.

5. A golf club including sighting apparatus according to claim 2:

wherein said shading includes a first shaded design which forms a target arrow on a center line of an upper surface of said adjustable wing member pointing on said sight line for said precise alignment of said golf club head face to address said golf ball on said sight line to said designated target; and wherein a second shaded design comprises a downswing arrow on a left front corner of said adjustable wing member, said downswing arrow being 45 degrees to said target arrow for proper positioning of said golf club during a downswing toward said golf ball, said downswing arrow following a vertical downward path during said downswing until said downswing arrow reaches its lowest point where a golfer's wrists unhinge and square at a 90 degree angle to said sight line of said golf ball.

6. A golf club including sighting apparatus according to claim 2:

wherein said attachment means is a pin located in an end of said support member 90 degrees to a lower surface of said support member for press-fitting into a cavity on an end surface of said golf club grip; and wherein said adjustable wing member is constructed from a flexible material for variance of its angle for setting said adjustable wing member parallel to the lower surface of said golf club head being a proper lie of said golf club head; and wherein said adjustable wing member is further adjustable by rotation of said adjustable wing member about a pin inserted into said cavity, said cavity running along the longitudinal axis of said golf club shaft.

7. A golf club including sighting apparatus according to claim 2:

wherein said shading includes a first shaded design which forms a target arrow on a center line of the upper surface of said adjustable wing member pointing on said sight line for said precise alignment of said golf club head face to address said golf ball on said sight line to said designated target; and wherein a second shaded design comprises a downswing arrow on a left front corner of said adjustable wing member, said downswing arrow being 45 degrees to said target arrow for proper positioning of said golf club during a downswing toward said golf ball, said downswing arrow following a vertical downward path during said downswing until said downswing arrow reaches its lowest point where a golfer's wrists unhinge and square at a 90 degree angle to said sight line of said golf ball; and wherein said target arrow is located on a protruding triangular tip section of said adjustable wing member for enhanced eye coordination along said sight line and said downswing arrow is located on a corner section of said adjustable wing member being at a 45 degree angle to said protruding triangular section.

8. A golf club including sighting apparatus according to claim 1 wherein said sighting apparatus comprises a right triangular frame member for fastening by said attachment means to said golf club shaft below said golf club grip, consisting of a first leg parallel to a lower surface of said golf club head at golf ball impact, said first leg having said upper surface with a first shaded design on a center line forming a target arrow pointing on a sight line.

9. A golf club including sighting apparatus according to claim 8 wherein said attachment means consists of a first means integral to an inner end of said first leg for circumventing said golf club shaft and a second means integral to said right triangular frame member at the intersection of a hypotenuse leg and a second leg perpendicular to said first leg for circumventing said golf club shaft.

10. A golf club including sighting apparatus according to claim 1 wherein said sighting means comprises a rectangular frame member for fastening by said attachment means to said golf club shaft below said golf club grip, consisting of a first leg parallel to a lower surface of said golf club head and at ball impact, said first leg having said upper surface with a first shaded design on a center line forming a target arrow pointing on a sight line, further consisting of a second leg parallel to said first leg, further consisting of a third leg parallel to a fourth leg running in a generally vertical direction, said first leg, said second leg, said third leg and said fourth leg creating a visual impression of a door closing shut at a point when said golf club head face impacts said golf ball, at said impact, said first leg and said second leg are parallel to a ground surface and said third leg and said fourth leg are generally perpendicular to said ground surface and to said first leg and said second leg.

11. A golf club including sighting apparatus according to claim 10 wherein said attachment means consists of a first means integral to an inner end of said first leg for circumventing said golf club shaft and a second means integral to said second leg at the intersection of said second leg and said third leg for circumventing said golf club shaft.

12. A golf club including sighting apparatus according to claim 1, wherein said sighting apparatus comprises a disk member having a disk diameter equal to a butt end diameter of said golf club grip said disk member being visually the closes point on said golf club to said golfer's eye.

13. A golf club including sighting apparatus according to claim 12:

wherein said attachment means is a pin located at a center point of a lower surface of said disk member being 90 degrees to said lower surface, of said disk member for press fitting into a cavity on a butt end surface of said golf club grip; and wherein a first shaded design forms a target arrow on a diameter line of said upper surface of said disk member pointing on a sight line for said precise alignment of said golf club head face to address said golf ball on said sight line to said designated target; and wherein a second shaded design comprises a downswing arrow being 45 degrees to and left of said target arrow for proper positioning of said golf club during a downswing toward said golf ball, said downswing arrow following a vertical downward path during said downswing until said downswing arrow reaches its lowest point where a golfer's wrists unhinge and square at a 90 degree angle to said sight line of said golf ball.

14. A golf club including sighting apparatus according to claim 1 wherein said golf club design consisting of a dark shading on a ½ sector upper surface and face surface of said golf club head and a light shading on an opposite upper and face surface forming a distinct center line on said upper and face surface of said golf club head, said center line visible to said golfer and being directional along said sight line to said designated target.

15. A method for precise alignment of a golf club head face to a golf ball for directing said golf ball to a designated target, the steps comprising:

attaching a golf club sighting apparatus to a golf club;

positioning said golf sighting apparatus, being an adjustable wing member, parallel to a lower surface of said golf club head face;

aligning said adjustable wing member in accordance with a shaded upper surface formed in the shape of a first arron located on a center line of said upper surface of said adjustable wing member for sighting said designated target along a sight line;

leveling said golf club head parallel to a ground surface representing a level lie of said golf club head;

further aligning said adjustable wing member of said golf club sighting apparatus parallel to said ground surface;

aligning said first arrow perpendicular to said golf club head face along said sight line to said designated target;

positioning a left hand of a golfer on a golf club grip so that the back of said left hand is perpendicular to said first arrow;

visually sighting along a colored, demarcated ¼ sector running vertically along said golf club grip and a golf club shaft, said sector being a front ¼ sector for visual extension to said golf club head face.

16. A method according to claim 15, wherein said adjustable wing member is shaded on said upper surface in the form of a second arrow, being a downswing arrow 45 degrees to said first arrow, is positioned such that when said golf club is placed vertically by said golfer for a downswing, said downswing arrow points in a vertical downward direction before unhinging, supination and rotation of said left wrist and a right wrist of said golfer such that said downswing arrow reaches its lowest point on said vertical downward direction at a time when said left wrist and said right wrist unhinge.

17. A method according to claim 16, wherein said golfer maintains said golf club head face perpendicular to said first arrow on said downswing for squaring said golf club head face to said golf club upon impact with said golf ball.

* * * * *